US006070646A

United States Patent [19]

Pleschiutschnigg

[11] Patent Number: 6,070,646

[45] **Date of Patent: *Jun. 6, 2000**

[54] CONTINUOUS CASTING APPARATUS

[75] Inventor: Fritz-Peter Pleschiutschnigg, Duisburg, Germany

[73] Assignee: Mannesmann Aktiengesellschaft, Düsseldorf, Germany

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/682,668

[22] PCT Filed: Jan. 19, 1995

[86] PCT No.: PCT/DE95/00096

§ 371 Date: Jul. 29, 1996

§ 102(e) Date: Jul. 29, 1996

[87] PCT Pub. No.: WO95/20447

PCT Pub. Date: Aug. 3, 1995

[30] Foreign Application Priority Data

Jan. 28, 1994 [DE] Germany ..... 44 03 046

[51] Int. Cl.[7] ..... B22D 11/041; B22D 11/128

[52] U.S. Cl. ..... 164/442; 164/448

[58] Field of Search ..... 164/448, 442, 164/459, 476, 484, 417, 424

[56] References Cited

U.S. PATENT DOCUMENTS

| | | | |
|---|---|---|---|
| 4,955,428 | 9/1990 | Schrewe | 164/442 X |
| 5,188,167 | 2/1993 | Perry et al. | 164/418 |
| 5,460,220 | 10/1995 | Coassin | 164/442 X |

FOREIGN PATENT DOCUMENTS

| | | | |
|---|---|---|---|
| 62-9758 | 1/1987 | Japan | 164/442 |
| 62-148064 | 7/1987 | Japan | 164/484 |
| 63-286259 | 11/1988 | Japan | 164/442 |
| 2-207953 | 8/1990 | Japan | 164/442 |
| 4-89161 | 3/1992 | Japan | 164/442 |
| 5-245604 | 9/1993 | Japan | 164/476 |
| 5-253645 | 10/1993 | Japan | 164/442 |
| 1771870 | 10/1992 | U.S.S.R. | 164/476 |

*Primary Examiner*—J. Reed Batten, Jr.
*Attorney, Agent, or Firm*—Cohen, Pontani, Lieberman & Pavane

[57] ABSTRACT

A continuous casting device comprises, in combination, a continuous casting mold for receiving molten metal, and at least one pair of guide rolls disposed immediately downstream of the mold exit opening. The exit opening of the mold is rectangular shaped so as to permit a rectangular strand to be cast which has a liquid core, a width and a thickness. The guide rolls are constructed so as to impart to the rectangular strand leaving the mold exit opening a convex shape so as to prevent snaking of the strand within the continuous casting device. The convexivity concavity extends along at least a part of the width of the strand and is no more than 8% of the strand thickness.

5 Claims, 4 Drawing Sheets

CONTINUOUS CASTING APPARATUS

BACKGROUND OF THE INVENTION

1. Field of the Invention

The invention is directed to a roll for a strand guide stand which prevents a weaving motion of the cast strand.

2. Description of the Prior Art

Strand guide stands in which the rolls have curved rather than straight surface lines are known from the prior art, e.g., DE 36 27 991 C2. Such rolls are used whenever the mold outlet cross section produces a strand cross section substantially deviating from a rectangular form.

Generally, for rectangular strands with strand thicknesses greater than 60 to 80 mm, rolls with straight surface lines are used in the strand guide stand directly below the continuous casting mold (segment 0) and the surface lines of rolls located opposite one another in pairs lie parallel to one another.

In strand guide stands having such rolls, the casting speed is limited by a weaving motion of the strands so that the following values are conventionally applied:

approximately 1.8–2.0 m/min for slabs with a thickness of 230 mm approximately 1.5–1.7 mn/min for blooms with a thickness of 270 mm approximately 2.5 m/min for billets with a size of 100× 100 mm.

SUMMARY AND DESCRIPTION OF THE INVENTION

Figure 1A:
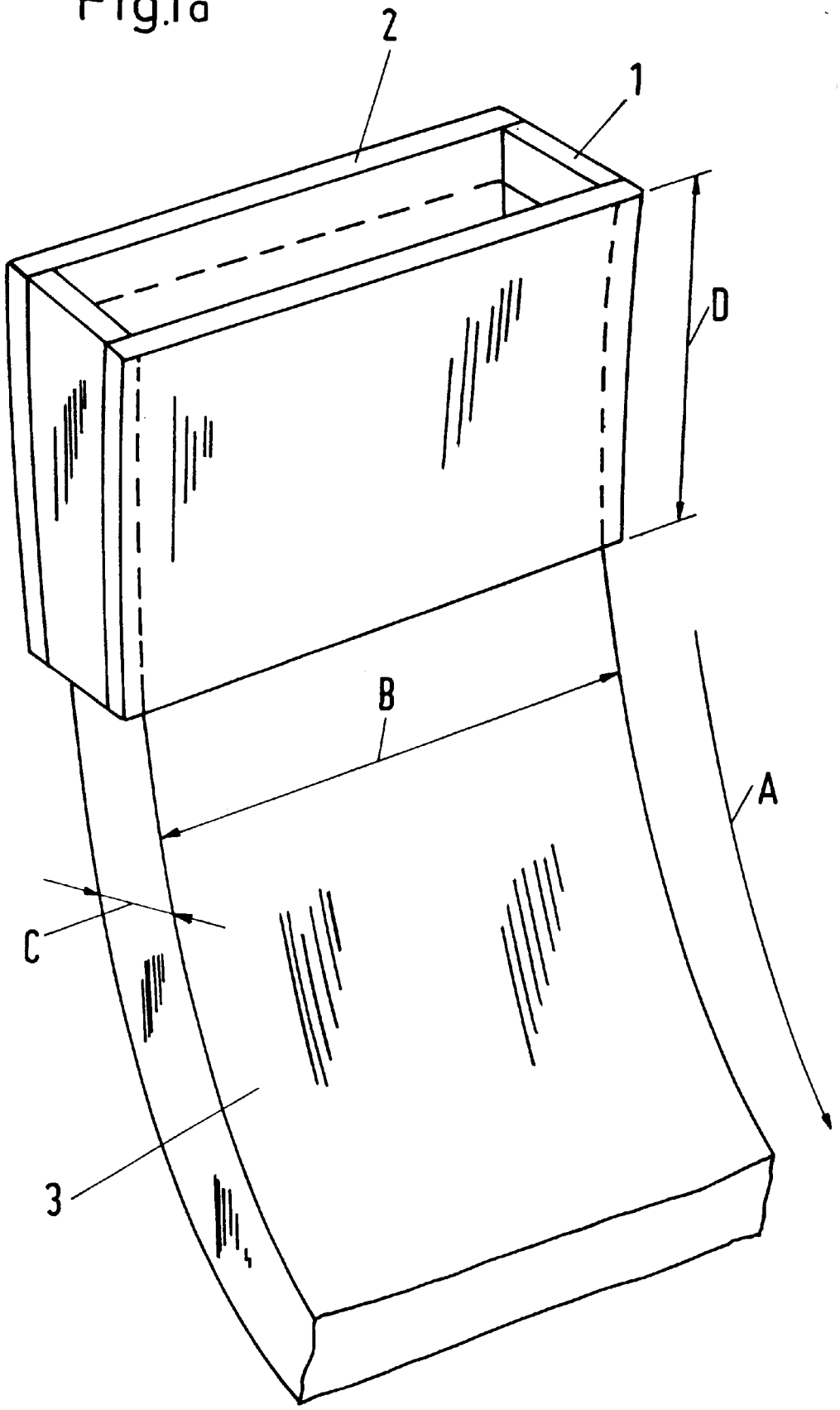
Figure 1B:
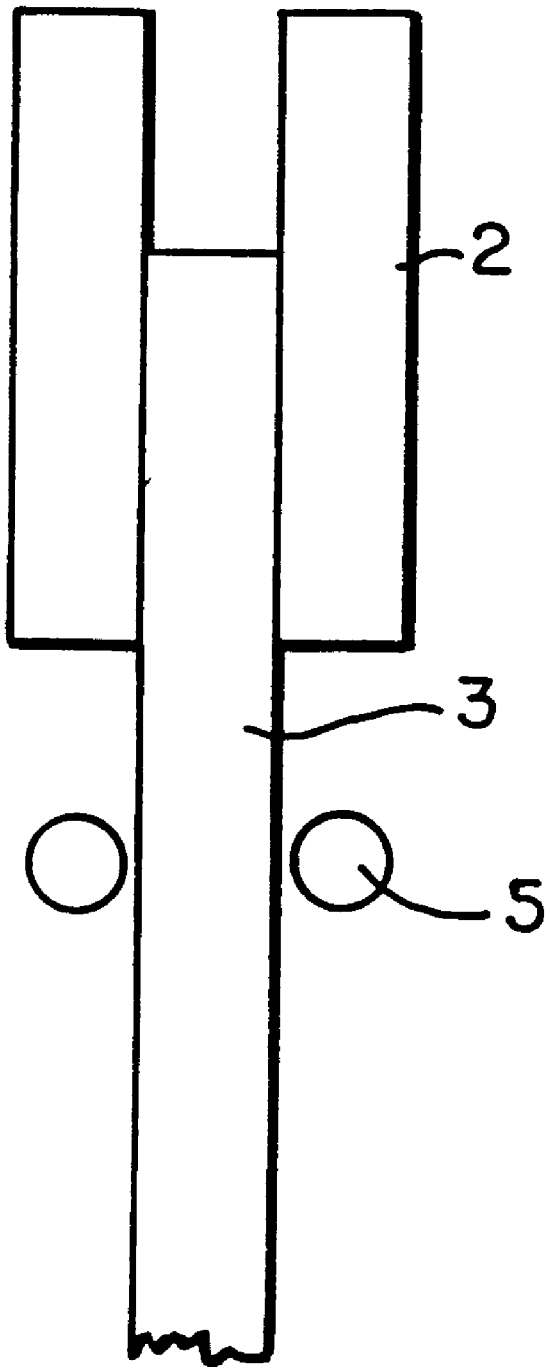

FIG. 1*a* is a schematic view of the rectangular mold and cast strand of the instant invention;

FIG. 1*b* is a schematic side view of FIG. 1*a;*

Figure 2:
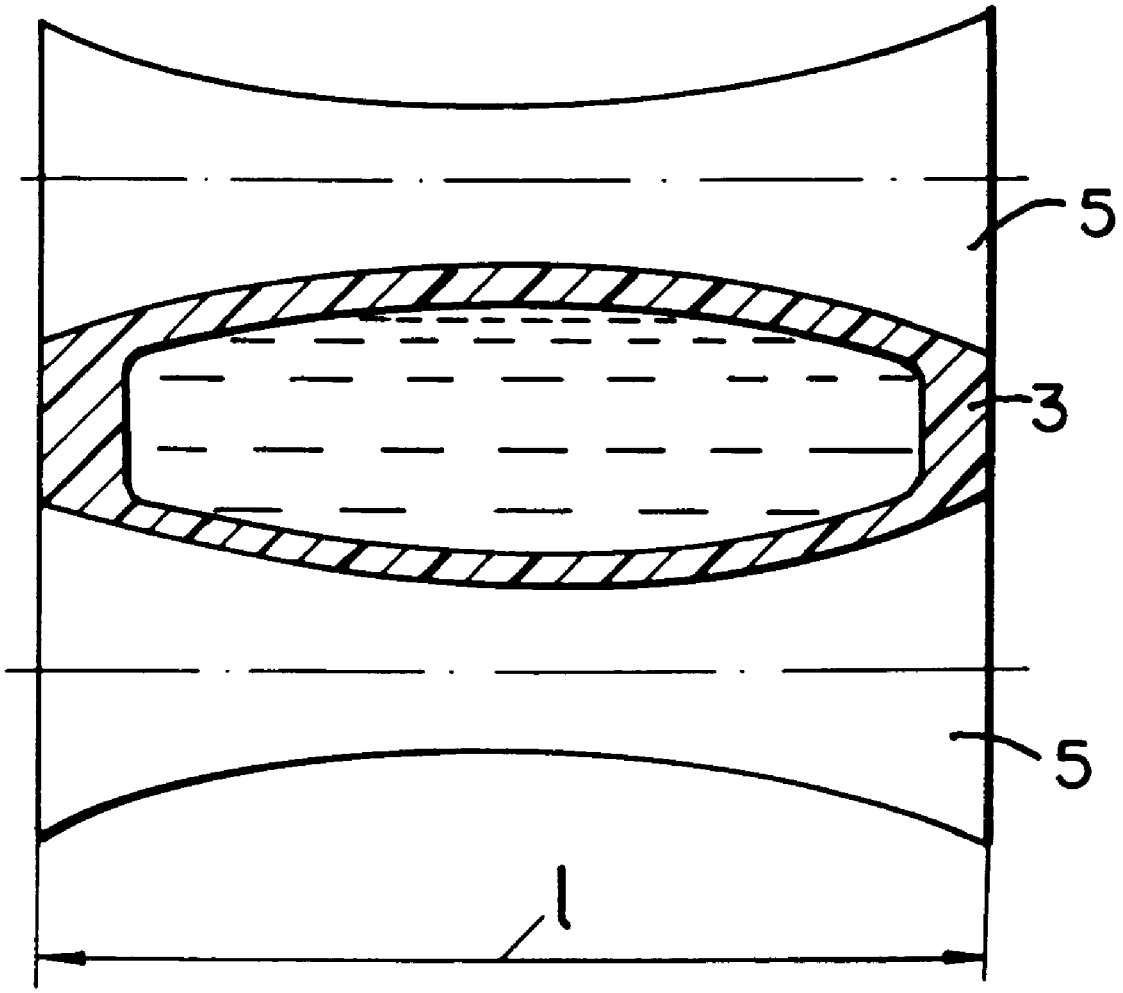
Figure 3A:
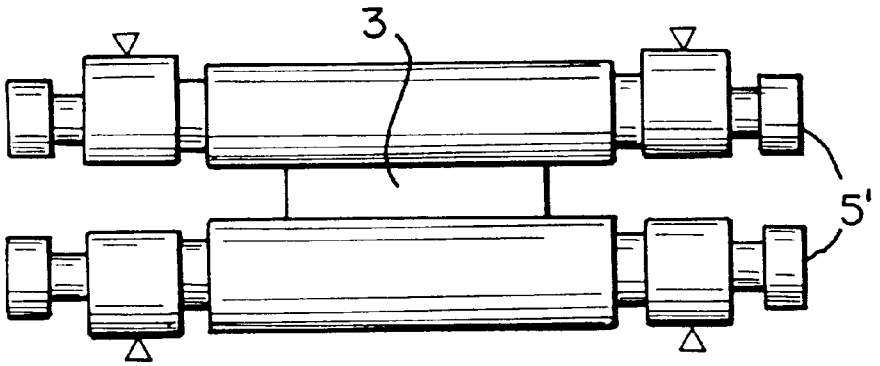
Figure 3B:
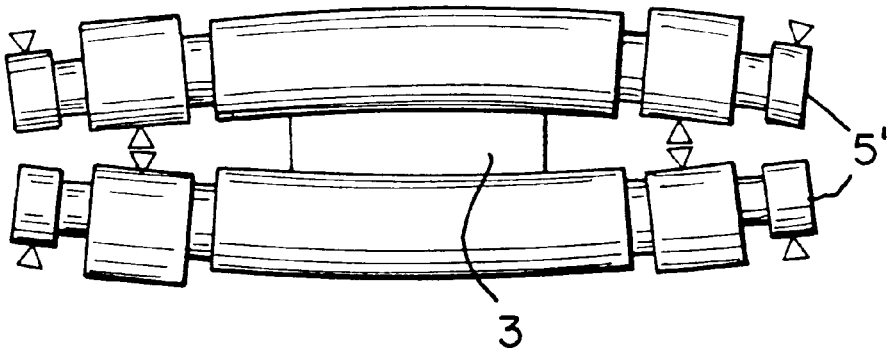

FIG. 2 is a partial cross-sectional view of the cast strand permitted to expand due to the concave surface line of the guide rolls;

FIG. 3*a* is a schematic view of the guide rolls of the instant invention in parallel position;

FIG. 3*b* is a view of the guide rolls in concave position.

The object of the present invention is to provide rolls for the strand guide stands for rectangular strands in which the rolls are designed so that a weaving or wobbling motion of the strands is prevented.

Pursuant to this object, and others which will become apparent hereafter, one aspect of the present invention resides in a roll for a guide stand for rectangular strands, which guide stand has guide rolls and driving rolls located opposite one another in pairs. The roll is provided with a cambered slightly concave surface line, at least when loaded so that the strand can be accurately guided without weaving. The slightly concave surface line allows the strand to expand spherically upon exiting from the continuous casting mold.

In another embodiment of the invention, the concave surface line only extends over part of the strand width, preferably 40%, thereof.

In yet another embodiment of the invention, the maximum concave surface line does not exceed 8%, and is preferably 2–4%, of the strand thickness.

In still another embodiment of the invention, the camber of the strand is achieved by correspondingly arranged split rolls. The camber of the strand can also be obtained by a corresponding bending of the rolls in a range of elasticity under casting loading.

Surprisingly, it has been shown that when using continuous casting molds with a rectangular cross section and cylindrical guide rolls, which is presently the case in the majority of continuous casting installations throughout the world, the casting speed may not exceed specified maximum values because, otherwise, the number of breakout defects in the strand increases disproportionately. This due to the fact that the strand begins to weave, that is, to move back and forth between the guide rolls, if a determined casting speed is exceeded. This leads to tilting and an uneven transfer of heat at the strand in the vicinity of the mold outlet cross section which, in turn, results in stress cracks and breakout.

FIG. 1 is a schematic view of the rectangular mold of the present invention with its narrow side 1 and broad side 2 and height D. The strand 3 cast with such rectangular mold has a length A, width B and thickness C. FIG. 2 is a partial cross-sectional and partially elevational view of the concavely shaped guide rolls 5 of the present invention, wherein 1 is the lenght of the roll for permitting the shell of the cast strand to assume a convex shape in accordance with the invention. FIGS. 3*a* and 3*b* show schematic views of the guide rolls 5' of the present invention whereby the concavity of the rolls has been achieved by bending of the rolls in the elasticity range under cast load as is known in the art.

Surprisingly, it has now been found that a slight camber of the strand prevents weaving. In so doing, the strand expands to the extent determined by the concave surface line of the rolls immediately upon exiting the mold due to the still liquid core and the small thickness of the strand shell. Thus it contacts the rolls and is guided so as to prevent weaving, or "snaking" as it is called in the technical literature.

The concave surface line of the rolls can extend over a part of the strand width or over the entire width of the strand. The total bulging of the strand should amount to 8%, preferably 2–4%. Increasing this value does not improve guidance, but only results in unnecessary rolling effort. A concave surface line of the rolls along the entire width of the strand in the range of 2–4% provides a substantially better initial cross section for the subsequent rolls and meets the requirements of rolling mill engineers in this respect.

The camber of the strand is expediently provided by means of (for example) concave rolls arranged up to the end of the strand guide or by means of a corresponding arrangement of split rolls in the strand guide stand or by means of bending the rolls in the elasticity range under cast load.

The present invention not only makes possible a corresponding increase in the casting speed in new installations, but also allows the casting speed in existing installations to be increased by up to 200% compared with the values indicated above by retrofitting with suitably designed rolls while at the same time increasing the reliability of the casting process.

What is claimed is:

1. A continuous casting device comprising in combination:

a) a continuous casting mold for receiving molten metal, said casting mold including a rectangular shaped exit opening for permitting a rectangular strand to be cast having a liquid core;

(b) a rectangular cast strand having a width and a thickness;

(c) at least one pair of guide rolls disposed immediately downstream of said mold exit opening and being constructed to have a concavity so as to impart to the rectangular strand leaving said mold exit opening a convex shape and so as to prevent snaking of the strand within the continuous casting device, said concavity extending along the guide roll so as to cover at least a part of the width of the strand at a maximum of up to 8% of the strand thickness.

2. The continuous casting device of claim 1, wherein the concavity extends along the guide roll so as to cover 40% of the strand width.

3. The continuous casting device of claim 1, wherein the convexity has a maximum of no more than 2–4% of the strand thickness.

4. The continuous casting device of claim 1, wherein the convexity is imparted to the rectangular strand leaving said mold exit opening by a corresponding bending of the guide rolls in the range of elasticity under cast load.

5. The continuous casting device of claim 1, wherein the convexity of the strand leaving the rectangular mold exit opening is imparted by correspondingly concave shaped guide rolls.

* * * * *